US008651401B2

(12) United States Patent
Stein et al.

(10) Patent No.: US 8,651,401 B2
(45) Date of Patent: Feb. 18, 2014

(54) JET REGULATOR AND SANITARY WATER OUTLET

(75) Inventors: Alexander Stein, Ihringen (DE); Hermann Grether, Muellheim (DE)

(73) Assignee: Neoperl GmbH, Muellheim (DE)

( * ) Notice: Subject to any disclaimer, the term of this patent is extended or adjusted under 35 U.S.C. 154(b) by 129 days.

(21) Appl. No.: 13/025,216

(22) Filed: Feb. 11, 2011

(65) Prior Publication Data

US 2011/0139283 A1 Jun. 16, 2011

Related U.S. Application Data

(63) Continuation of application No. PCT/EP2009/003437, filed on May 14, 2009.

(30) Foreign Application Priority Data

Aug. 12, 2008 (DE) ..... 20 2008 010 717

(51) Int. Cl.
*B05B 1/14* (2006.01)

(52) U.S. Cl.
USPC ..... 239/552; 239/428.5; 239/553; 239/590; 239/600

(58) Field of Classification Search
USPC ..... 239/428.5, 548–568, 590, 600
See application file for complete search history.

(56) References Cited

U.S. PATENT DOCUMENTS

| | | | | |
|---|---|---|---|---|
| 3,587,975 | A * | 6/1971 | Moffett | 239/428.5 |
| 4,474,329 | A | 10/1984 | Finkbeiner | |
| 6,267,305 | B1 * | 7/2001 | Kondo | 239/428.5 |
| 6,789,749 | B2 * | 9/2004 | Liu | 239/428.5 |
| 6,935,581 | B2 * | 8/2005 | Titinet | 239/548 |
| 2008/0223957 | A1 | 9/2008 | Schorn | |

FOREIGN PATENT DOCUMENTS

| | | | |
|---|---|---|---|
| DE | 31 10 029 | A1 | 9/1982 |
| DE | 102 49 340 | A1 | 5/2004 |
| DE | 10 2004 059 329 | A1 | 6/2006 |
| DE | 20 2005 003 728 | U1 | 8/2006 |
| DE | 20 2006 007 409 | U1 | 10/2007 |
| DE | 20 2007 014 777 | U1 | 4/2009 |
| GB | 685463 | A | 1/1953 |

OTHER PUBLICATIONS

International Search Report including English translation dated Nov. 30, 2009 and PCT/ISA/237 Form (Twenty-two (22) pages).

* cited by examiner

*Primary Examiner* — Dinh Q Nguyen
(74) *Attorney, Agent, or Firm* — Crowell & Moring LLP

(57) ABSTRACT

A jet regulator or jet aerator is provided with a jet regulator housing insertable into a water outlet and detachably held therein by threaded or bayonet connection. The jet regulator housing has an outflow-side housing partial region with a reduced housing outer circumference compared to the inflow-side housing partial region, and the outflow-side housing partial region is insertable into an insert opening of a turning tool such that the turning tool can be applied to a tool working surface in a rotationally fixed manner. The tool working surface is provided on the outflow-side frontal edge, the housing circumference of the outflow-side housing partial region and/or an annular shoulder surrounding the housing partial region on the outside. A sanitary water outlet is also provided, which for a plurality of visibly separately emerging water jets has a corresponding plurality of water outflows spaced apart from one another.

16 Claims, 10 Drawing Sheets

JET REGULATOR AND SANITARY WATER OUTLET

CROSS REFERENCE TO RELATED APPLICATIONS

This application is a continuation of PCT International Application No. PCT/EP2009/003437, filed May 14, 2009, and claims priority under 35 U.S.C. §119 to German Patent Application No. 20 2008 010 717.2, filed Aug. 12, 2008, the entire disclosures of which are herein expressly incorporated by reference.

BACKGROUND AND SUMMARY OF THE INVENTION

The invention relates to a jet regulator or jet aerator with a jet regulator housing, which can be inserted into a water outlet and detachably held therein by means of a threaded or bayonet connection.

The invention also deals with a sanitary water outlet, which for a plurality of visibly separately emerging water jets has a corresponding plurality of water outflows spaced apart from one another.

Sanitary water outlets have already been created in a variety of embodiments. For example, jet aerators are already known, which can be mounted with their jet aerator housing at the outlet end of a sanitary outlet fitting. The previously known jet aerators divide the inflowing water flow in the interior of their jet aerator housing into a multiplicity of individual jets in order to mix these individual jets with ambient air suctioned in and to form these individual jets mixed with air in this manner again into a homogenous, sparkling soft and non-splashing total jet.

Spray heads are known that eject the inflowing water as spray jets visibly separated from one another. If these spray jets are to emerge as aerated individual jets, i.e., as so-called "champagne jets," an aeration device is arranged upstream of the previously known spray heads in the flow direction, which aeration device aerates the inflowing water before it is divided into the individual spray jets. However, the expenditure in terms of space and construction associated with the upstream arrangement of an aeration device is high. The spray heads designed to produce champagne jets of this type are comparatively clunky and expensive to produce due to the integrated aeration device.

Exemplary embodiments of the present invention provide an aerated or un-aerated jet regulator as well as a water outlet of the type mentioned at the outset, which can be produced in a compact and cost-effective manner and is versatile in use.

Exemplary embodiments of the present invention provide a jet regulator or jet aerator of the type mentioned at the outset with a jet regulator housing having an outflow-side housing partial region with a reduced housing outer circumference compared to the inflow-side housing partial region, and the outflow-side housing partial region can be inserted into an insert opening of a turning tool such that the turning tool can be applied to a tool working surface in a rotationally fixed manner. The tool working surface is provided on the outflow-side frontal edge and/or on the housing circumference of the outflow-side housing partial region and/or on an annular flange wrapping around the housing partial region on the outside.

The jet regulator according to the invention, which can be embodied as an aerated or un-aerated jet regulator and thus also as a jet aerator, has an outflow-side housing partial region that has a reduced housing outer circumference compared to the inflow-side housing partial region. The jet regulator housing can be inserted with its housing partial region with reduced outer circumference into an insert opening of a turning tool such that the turning tool can be applied to a tool working surface in a rotationally fixed manner. Since the housing partial region with reduced outer circumference is aligned or centered in the insert opening of the turning tool, even a small compact jet regulator can be handled and mounted easily. The jet regulator that can be inserted with its outflow-side housing partial region into the insert opening of the turning tool can be aligned in a simple manner such that even inexperienced users can bring the turning tool and the jet regulator into a relative position to one another such that the turning tool easily finds the tool working surface provided on the jet regulator.

A preferred exemplary embodiment according to the invention thereby provides that the tool working surface is embodied in a crown-shaped manner and/or has at least one indentation or cavity that interacts with a mating surface on the turning tool embodied in a complementary manner.

Another exemplary embodiment according to the invention provides the outflow-side housing partial region of the jet regulator housing being embodied in a sleeve-shaped manner, the water outflow of the jet regulator being formed by a flow straightener, which has flow-through holes arranged in a plane oriented transversely to the flow-through direction and defined by flow guide walls, and the outflow-side frontal edge of the housing partial region being embodied in a sleeve-shaped manner projects in the axial direction with a spacing over the flow straightener.

A jet regulator produced according to this suggested solution has an outflow-side housing partial region embodied in a sleeve-shaped manner, the outflow-side frontal edge of which projects with a spacing over the flow straightener. Even with a compact and optionally also miniaturized design, this jet regulator according to the invention is characterized by an emerging water jet that virtually does not splash beyond the jet circumference.

It is particularly advantageous if the outflow-side housing partial region is embodied as an effective centering aid during insertion into the insert opening of the turning tool.

The alignment and centering of the turning tool in relation to the jet regulator housing is further facilitated if the outflow-side frontal edge of the jet regulator housing projects in the axial direction over the annular flange having the tool working surface.

Another exemplary embodiment of the invention, which is characterized by the versatile applicability of this jet regulator according to the invention, provides that at least one sealing ring is provided for the axial and/or radial sealing of the jet regulator with respect to a line section adjacent on the inflow side and in particular with respect to a sanitary outlet fitting, and that at least one sealing ring is provided in an annular groove arranged on the jet regulator housing on the outer circumferential side and/or in a housing receptacle arranged on the housing frontal face on the inflow side. The jet regulator embodied according to this suggested solution can be sealed axially and/or radially on the housing circumferential side, if necessary. "On the housing circumferential side" means that a seal of this type seals the annular gap between the housing outer circumference of the jet regulator housing and an inner circumferential wall, for example, of the fitting outlet of the sanitary outlet fitting.

In the water outlet of the type mentioned at the outset, the solution according to the invention lies in that respectively one jet aerator is provided in at least a plurality of the water outflows, that each of these jet aerators has a cross-sectional narrowing that accelerates the partial quantity of the water flowing to the water outlet flowing through the jet aerator such that an underpressure is produced on the outflow side of the cross-sectional narrowing, and that each jet aerator has a mixing region following its cross-sectional narrowing for mixing the partial quantity flowing through with ambient air suctioned in due to the underpressure such that an aerator water jet emerges from each jet aerator.

The water outlet according to the invention has a plurality, i.e., at least two, water outflows spaced apart from one another. Respectively one miniaturized jet aerator is provided in all of the water outflows, but at least in a plurality of these water outflows. Whereas one total jet shaped in a homogeneous manner from aerated individual jets emerges from conventional jet aerators, visibly separated champagne jets accordingly spaced apart from one another emerge from the water outlet according to the invention. Each of the jet aerators provided in the water outflows of the water outlet according to the invention has a cross-sectional narrowing that accelerates the partial quantity of the water flowing to the water outlet flowing through the jet aerator such that an underpressure is produced on the outflow side of the cross-sectional narrowing. Each jet aerator has a mixing region following its cross-sectional narrowing for mixing the partial quantity flowing through with ambient air suctioned in due to the underpressure, such that an aerated water jet emerges from each jet aerator. The miniaturized jet aerators used can thereby be sized so small that the water outlet according to the invention can also be embodied in a very compact and space-saving manner. The jet aerators can thereby be produced in a cost-effective manner as small knob-shaped or rivet-shaped plastic parts.

The components necessary for the jet aerators used according to the invention can also be integrated individually into the assigned water outflow, if necessary. However, it is easier if each jet aerator has a jet aerator housing and if the jet aerator housings can be respectively inserted into a through opening of the water outlet.

The jet regulators according to the invention can be attached in the water outflows assigned thereto in a sufficiently stable and captive manner, without screw means, adhesive means or other expensive connecting means being necessary, if at least one jet regulator with its preferably mushroom-shaped or rivet-shaped jet regulator housing can be inserted from the inflow side of the water outlet therein up to an insert stop projecting on the circumferential side on the jet regulator housing.

An embodiment according to the invention that is particularly easy to produce and also therefore preferably provides that the insert stop is embodied as a surrounding annular flange.

In order that the ambient air necessary to produce the champagne jets can be suctioned into the interior of the jet aerators used according to the invention, it is advantageous if, on the circumferential side on the jet aerator housing, at least one aerating opening is provided that opens into the housing interior. This aerating opening could optionally also be fed via central aerating ducts assigned to several jet aerators simultaneously. A preferred embodiment according to the invention, however, provides that between at least one jet aerator housing and the edge region of the water outlet delimiting the through opening at least one aerating duct is arranged leading from the outflow side of the water outlet to at least one aerating opening.

An aerating duct of this type can thereby be produced particularly simply if the jet aerator housing has, in the region of the at least one aerating opening, a housing cross-section enlarged in comparison with the housing partial region arranged on the outflow side and preferably tapering conically in the direction of the outflow-side housing partial region.

In order to be able to produce the jet regulator in the required miniaturized size, it is advantageous if the jet regulator has a central insert part that has at least one through opening. This central insert part can be embodied in a particularly simple manner as a diffuser dividing the inflowing water, if a blind hole is provided on the center insert part, the circumferential-side hole wall of which blind hole has the at least one through opening.

In order to embody the cross-sectional narrowing required in the jet regulator according to the invention in a simple manner, it is advantageous if the first central insert part can be inserted into a sleeve-shaped second insert part and if the first insert part and the second insert part delimit the cross-sectional narrowing preferably embodied as an annular channel.

A particularly effective and high-performance embodiment according to the invention thereby provides that the cross-sectional narrowing is embodied as a channel preferably tapering conically in the flow direction.

The jet regulator according to the invention can be assembled from a few components with low expenditure if the first insert part can be inserted into the second insert part and the second insert part can be inserted into the jet regulator housing, and if an insert stop respectively delimits the insert path. A preferred further development according to the invention thereby provides that the first insert part and/or the second insert part have an insert stop embodied as an annular shoulder, which interacts with an insert counter-stop embodied on the inner circumference of the second insert part or the jet regulator housing as an annular stop surrounding preferably in an annular manner.

In order to be able to embody respectively one clearly defined mixing region in the interior of the jet aerators used according to the invention, it is advantageous if the first insert part and the second insert part on the outflow side extends up to a housing section of the jet aerator housing reaching into the region of the at least one aerating opening.

A water outlet is characterized by at least one non-splashing water jet that is homogenous in a thread-like manner, if at least one water passage element embodied as a jet regulating device, as a homogenization device or as a flow straightener and embodied as a network structure or lattice structure is provided after the cross-sectional narrowing in the flow direction.

A preferred embodiment according to the invention, in which the jet regulator or at least its essential components are held on the water outlet in a virtually captive manner, provides that a mounting flange projects on the circumferential side on the first central insert part, on the second insert part and/or on the jet regulator housing, which mounting flange can be connected preferably tightly in a surrounding manner to the edge region of the water outlet bordering the water outflow. In this embodiment, a mounting flange is provided on the central insert part, on the second insert part and/or on the jet regulator housing, which mounting flange can be connected to the edge region bordering the water outflow. If this mounting flange is connected to the edge region bordering the water outflow tightly in a surrounding manner, undesirable and uncontrolled leakage flows—past the jet regulator—are avoided.

It is particularly advantageous if the at least one mounting flange is welded, adhered or otherwise connected to the edge region surrounding the water outflow.

A further aspect according to the invention of independently patentable significance provides that the water outlet has a retaining plate that can be inserted into an outlet nozzle, which retaining plate preferably has a plurality of water outflows, in which water outflows preferably respectively one jet aerator is provided. The jet aerators produced in miniaturized form make it possible to also produce the jet regulator that can be mounted at the outlet end of a sanitary outlet fitting with the aid of an outlet nozzle in a modular manner from one or preferably several individual jet aerators. The number of jet aerators necessary can thereby be determined according to the required flow-through capacity per time unit.

Further features according to the invention are shown by the specification and the claims. The invention is described in even more detail below based on preferred exemplary embodiments.

Other objects, advantages and novel features of the present invention will become apparent from the following detailed description of one or more preferred embodiments when considered in conjunction with the accompanying drawings.

BRIEF DESCRIPTION OF THE DRAWINGS

They show.

DETAILED DESCRIPTION OF THE DRAWINGS

In FIGS. 1-38 different embodiments 1, 2, 20, 21, 22, 50, 51 of a miniaturized jet aerator are shown, which is provided for insertion into a sanitary water outlet 3, 4, 5. As is shown by way of example in FIGS. 16-18 in three different embodiments 3, 4, 5, the water outlet can also have for a plurality of visibly separately emerging water jets a corresponding plurality of water outflows 6 spaced apart from one another.

Figures 1, 2, 3, 4, 5, 6, 7:
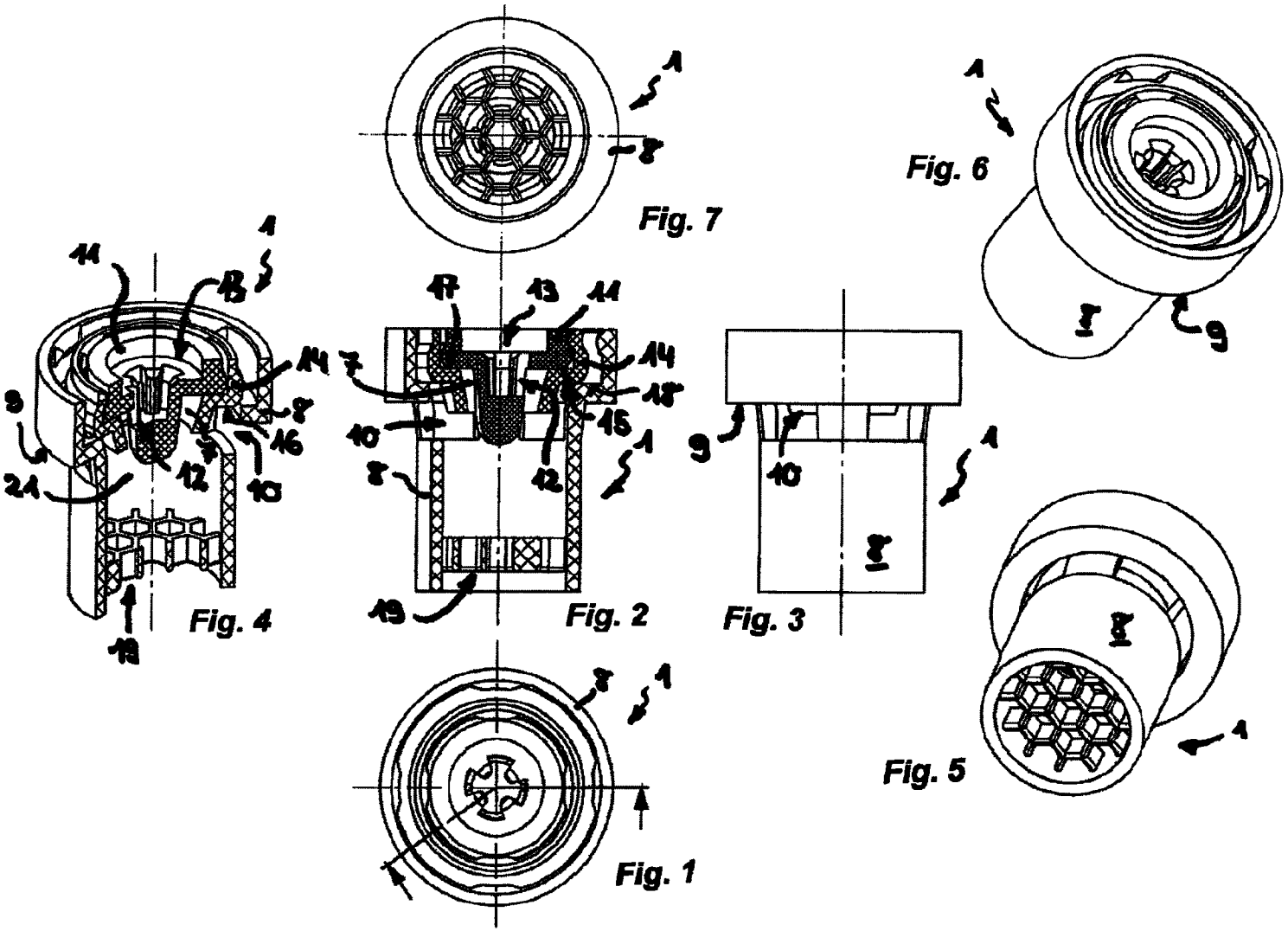
FIG. 1—The jet aerator of a water outlet provided for insertion into respectively one water outflow, which water outlet for a plurality of water jets emerging in a visibly separated manner has a corresponding plurality of water outflows spaced apart from one another, wherein the jet aerator is shown in a plan view on its inflow-side frontal face, FIG. 2—The jet aerator from FIG. 1 in a longitudinal section, FIG. 3—The jet aerator from FIGS. 1 and 2 in a side view, FIG. 4—The jet aerator from FIGS. 1-3 in a perspective longitudinal section through the section plane shown in FIG. 1, FIG. 5—The jet aerator from FIGS. 1-4 in a perspective plan view on its outlet frontal side, FIG. 6—The jet aerator from FIGS. 1-5, in a perspective plan view on its inflow-side frontal face, FIG. 7—The jet aerator from FIGS. 1-6 in a plan view on its outlet-side frontal face, FIG. 8—A jet aerator comparable with FIGS. 1-7 in a plan view on its inflow-side frontal face, wherein a flow straightener arranged on the outflow side is integrated into the jet aerator, which flow straightener here is not embodied as honeycomb-shaped or lattice-shaped or network-shaped throughput structure but is embodied only as a guide cross, FIG. 9—The jet aerator from FIG. 8 in a longitudinal section, FIG. 10—The jet aerator from FIGS. 8 and 9 in a side view, FIG. 11—The jet aerator from FIGS. 8-10 in a perspective longitudinal section through the section plane shown in FIG. 8, wherein the flow straightener located in the interior of the jet aerator housing and embodied as a guide cross can be clearly seen, FIG. 12—The jet aerator from FIGS. 8-11 in a perspective plan view on its outlet frontal side, FIG. 13—The jet aerator from FIGS. 8-12 in a perspective plan view on its inflow-side frontal face, FIG. 14—The jet aerator from FIGS. 8-13 in a plan view on its outlet-side frontal face, FIG. 15—The jet aerator from FIGS. 8-14 in a considerably enlarged representation drawn apart of its individual parts, FIG. 16—A water outlet embodied as a spray head, as an outlet frontal side of a flat jet regulator or as a partial region of a fitting body, which water outlet has a plurality of water outflows spaced apart from one another in a V-shaped manner and equipped with respectively one jet aerator, FIG. 17—A water outlet comparable with FIG. 16, in which the water outflows are arranged in rows with respect to one another, FIG. 18—A water outlet comparable with FIGS. 16 and 17, in which a plurality of water outflows spaced apart from one another are arranged concentrically around a central water outflow, FIG. 19—A jet aerator produced from a first central insert part, a second insert part and a jet aerator housing in a longitudinal section, wherein a mounting flange projects on the second insert part on the circumferential side, with which the jet aerator can be connected preferably tightly on the water outflow of the water outlet accommodating it, FIG. 20—The jet aerator from FIG. 19 in a plan view of the inflow-side frontal face, FIG. 21—The jet aerator already shown in FIGS. 19 and 20 and here likewise shown in longitudinal section, the mounting flange of which is here welded, adhered or otherwise connected to the water outflow tightly in a surrounding manner, FIG. 22—The jet aerator attached to the water outlet from FIGS. 19-21 in a plan view of its inflow frontal side, FIG. 23—A jet regulator constructed in a modular manner, which here has only one central jet aerator, wherein the jet aerator is shown in a plan view on its outlet frontal side, FIG. 24—The jet regulator from FIG. 23, in a longitudinal section, FIG. 25—The jet regulator constructed in a modular manner from FIGS. 23 and 24 in a plan view of the outlet frontal side, wherein the jet regulator here has three jet aerators, FIG. 26—The jet regulator from FIG. 25 in a longitudinal section, FIG. 27—A jet aerator formed from a first central insert part and a second insert part in a longitudinal section, wherein the jet aerator is inserted into the water outlet directly and without the aid of a jet aerator housing, FIG. 28—The jet aerator from FIG. 27 in a plan view on its inflow side, FIG. 29—A jet regulator radially sealed on the housing circumferential side in a longitudinal section, wherein the jet regulator has an outflow-side housing partial region, which projects with a spacing over a flow straightener arranged in a plane oriented transversely to the flow-through direction, FIG. 30—The jet regulator from FIG. 29 in a side view, FIG. 31—The jet regulator from FIGS. 29 and 30 in a perspective side view, FIG. 32—The jet regulator from FIGS. 29-31 in a plan view on its inflow frontal side, FIG. 33—The jet regulator shown in a longitudinal section and comparable with FIGS. 29-32 in an embodiment sealed axially on a housing circumferential side, FIG. 34—The jet regulator embodiment from FIG. 33 in a side view, FIG. 35—The jet regulator embodiment from FIG. 34 in a perspective side view, FIG. 36—The jet regulator from FIGS. 33-35 in a plan view on its inflow frontal side, FIG. 37—The jet regulator shown in FIGS. 29-32 in a longitudinal section shown in an installation situation directly before the application of a turning tool, and FIG. 38—The jet regulator shown in FIGS. 33-36 in a longitudinal section likewise shown in an installation situation directly before the application of the turning tool.
Figures 8, 9, 10, 11, 12, 13, 14:
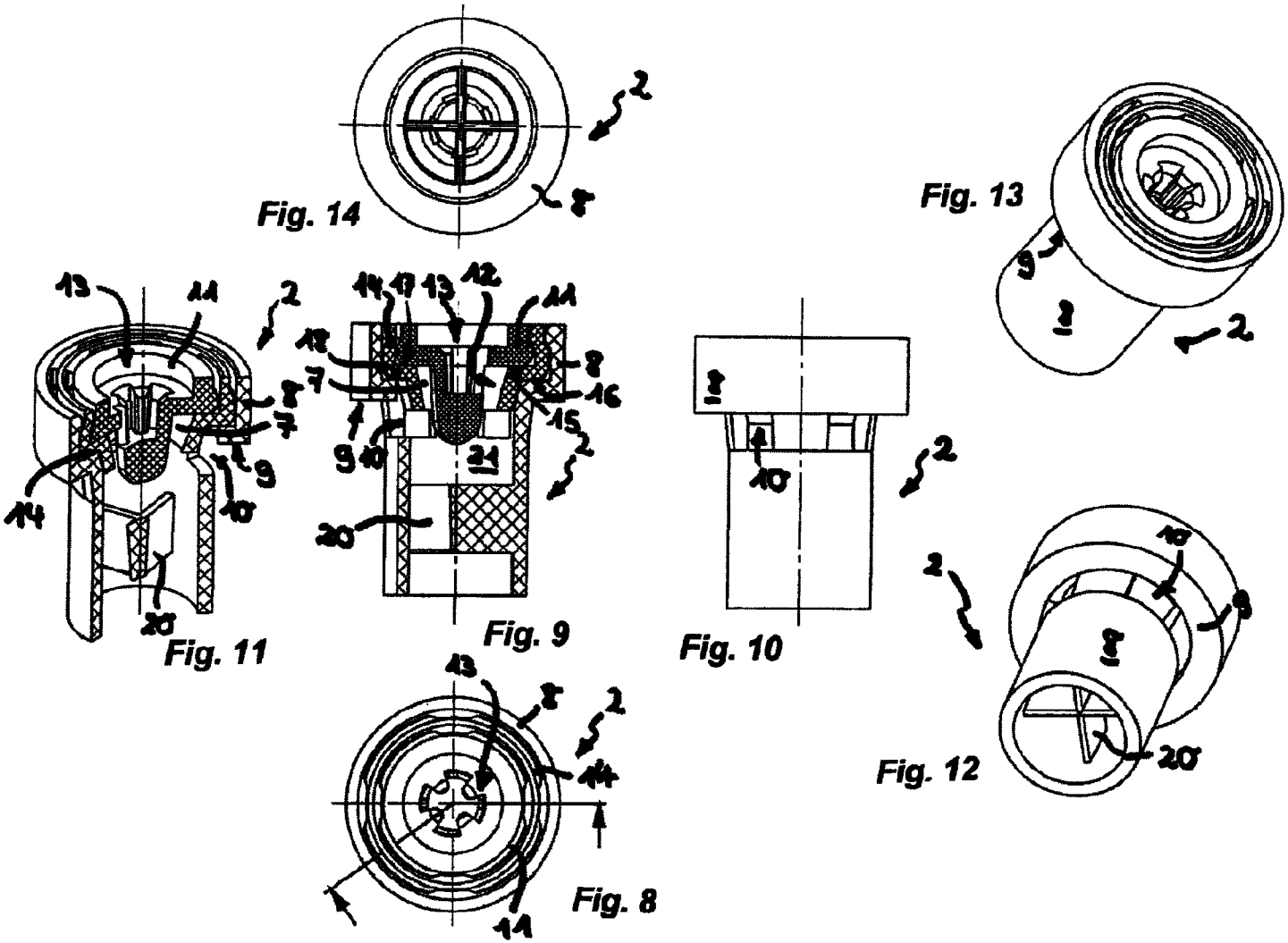
Figure 15:
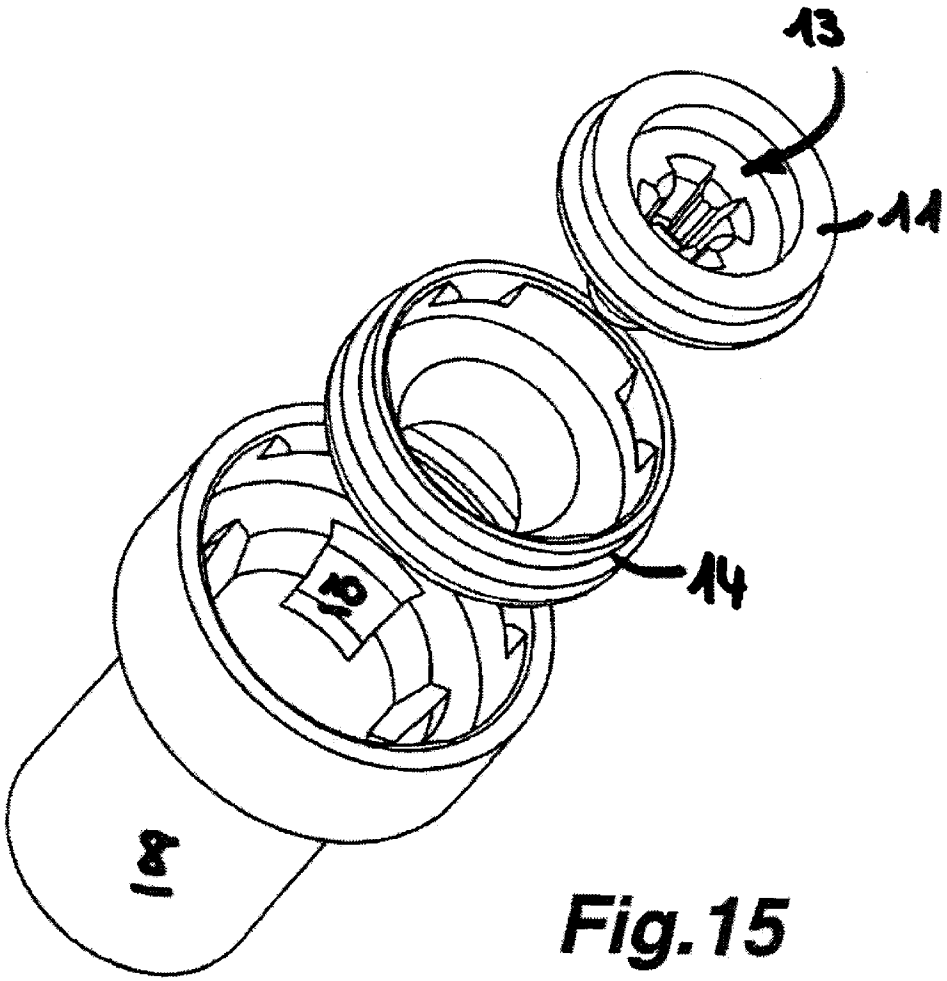
Figure 18:
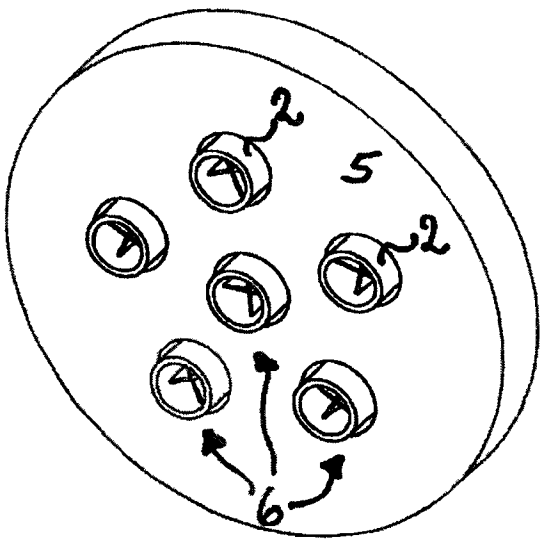
Figure 16:
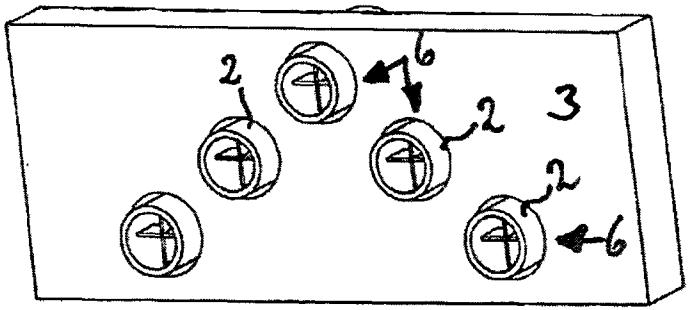
Figure 17:
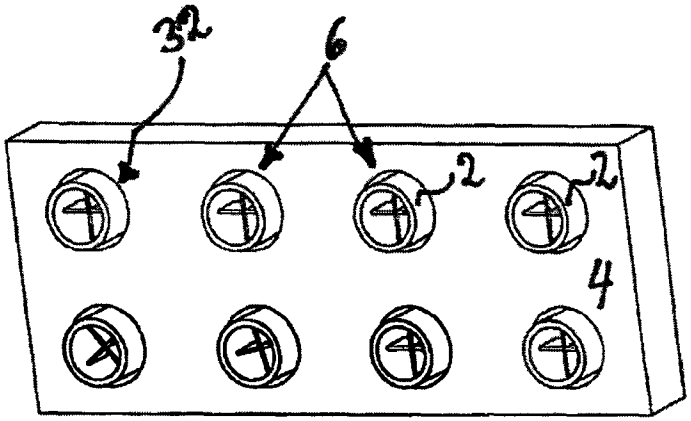
Figure 21:
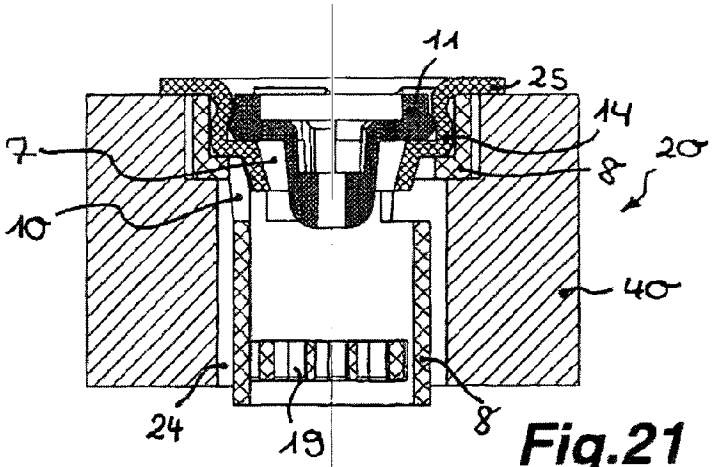
Figure 22:
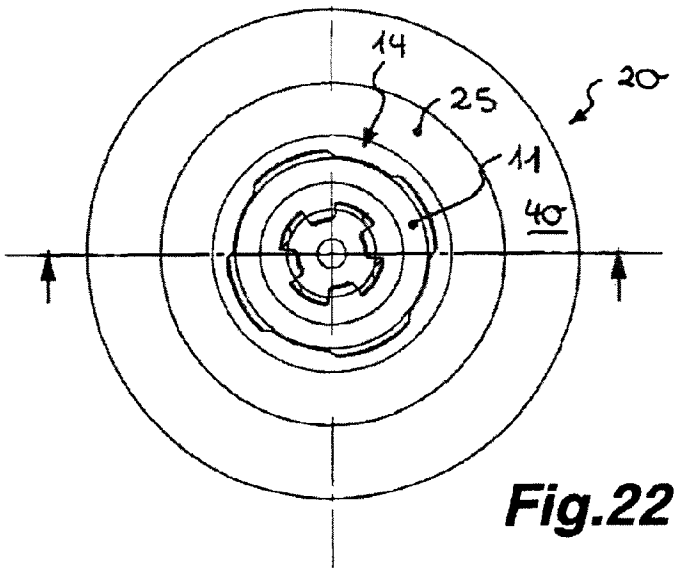
Figure 19:
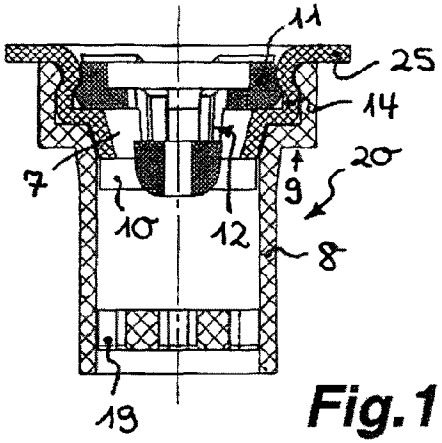
Figure 20:
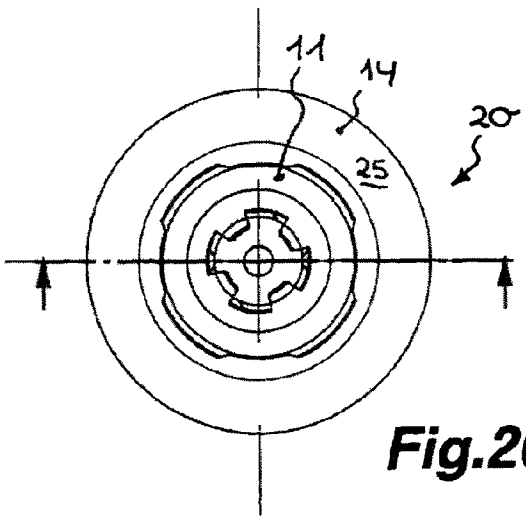
Figure 23:
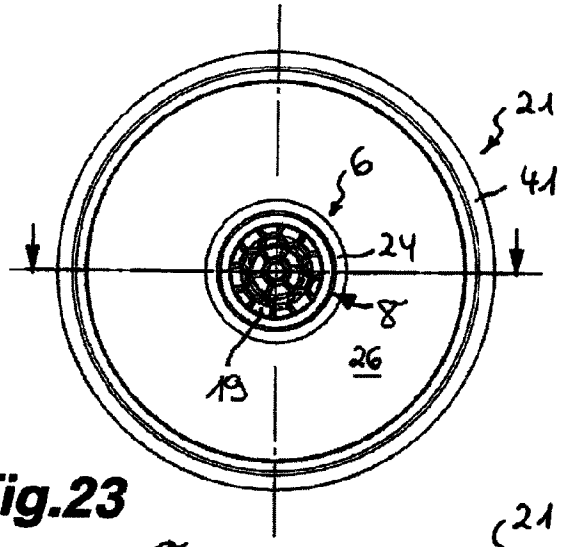
Figure 24:
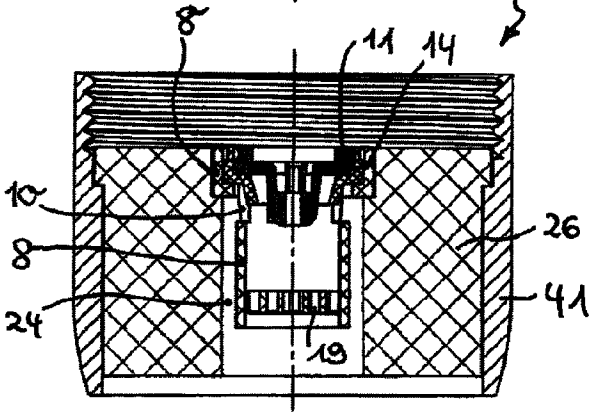
Figure 25:
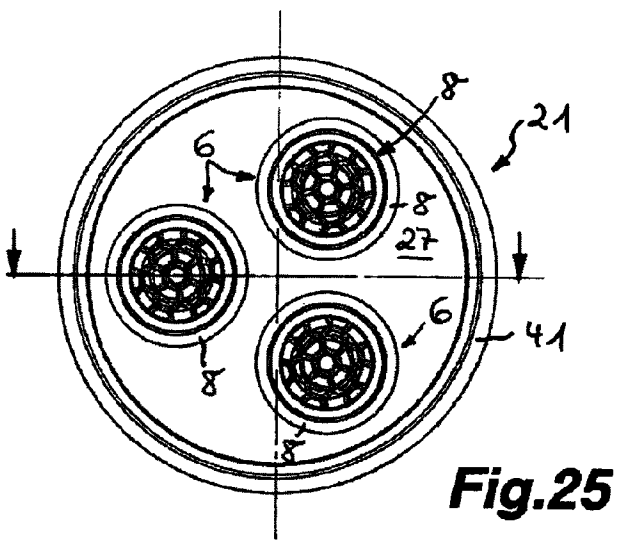
Figure 26:
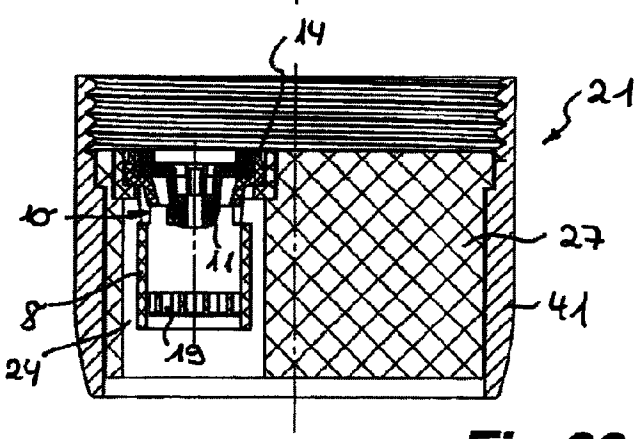

In the exemplary embodiments of the water outlet 3, 4, 5 shown in FIGS. 16-18, respectively one jet aerator 1, 2, 20, 21, 22, 50 or 51 is provided in all of these water outflows 6. It is clear from the longitudinal sections in FIGS. 2, 4, 9, 11, 19, 21, 24, 26, 27, 29, 33, 37 and 38 that each of these jet aerators has a cross-sectional narrowing 7, which accelerates the partial quantity of the water flowing to the water outlet flowing through the jet aerator 1, 2, 20, 21, 22, 50, 51 such that an underpressure is produced on the outflow side of the cross-sectional narrowing 7.

Figure 27:
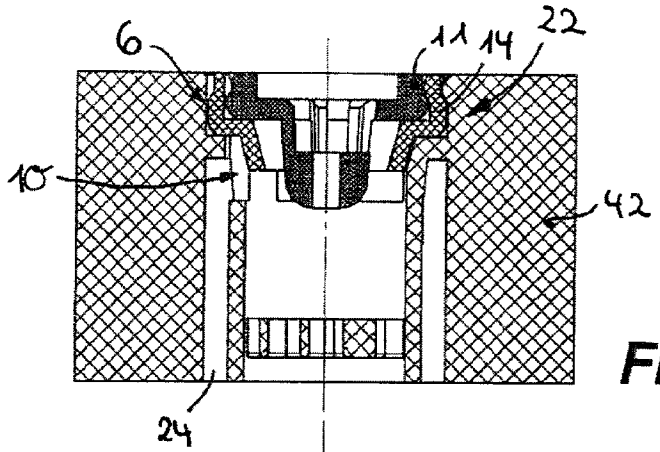
Figure 28:
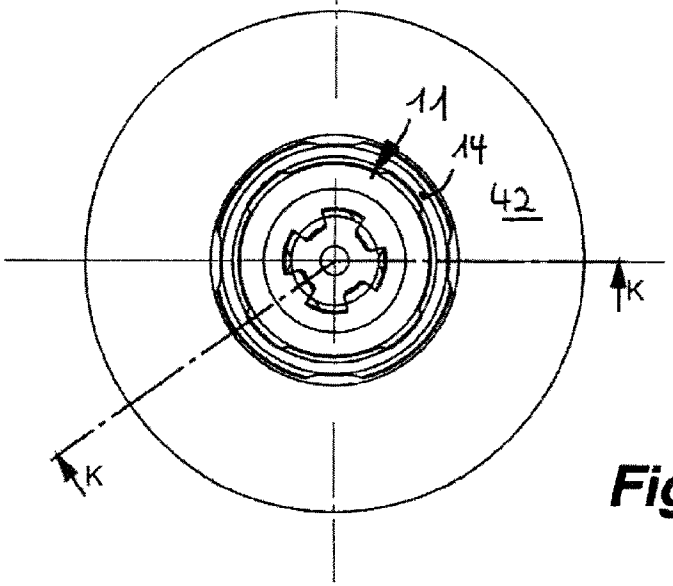
Figure 30:
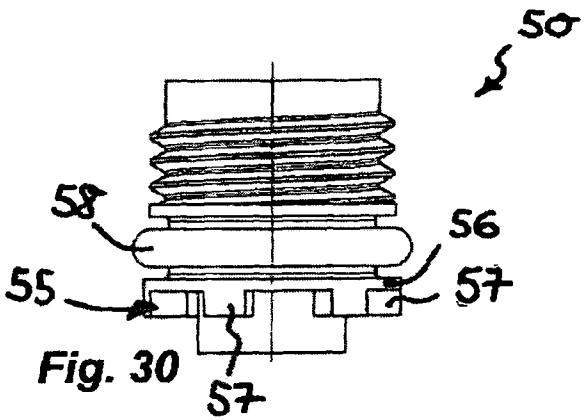
Figure 31:
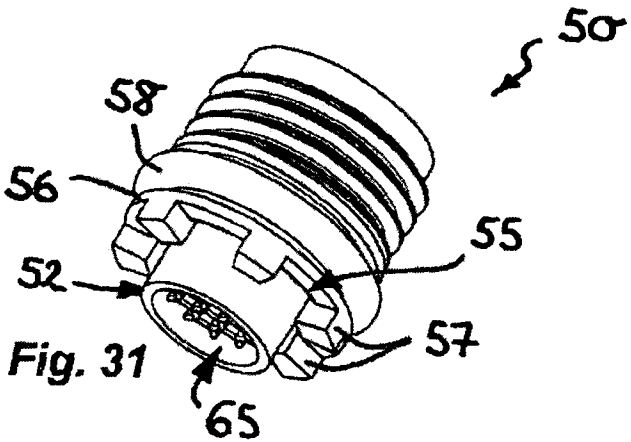
Figure 29:
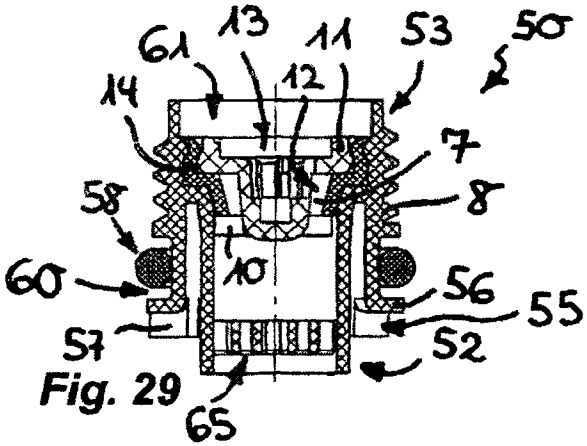
Figure 32:
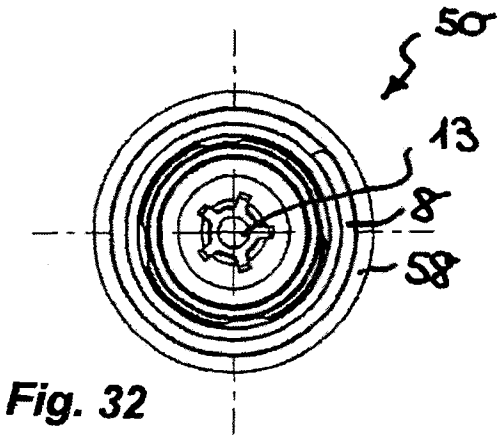
Figure 34:
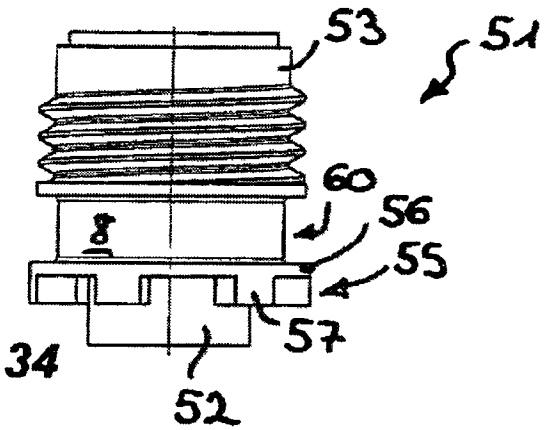
Figure 35:
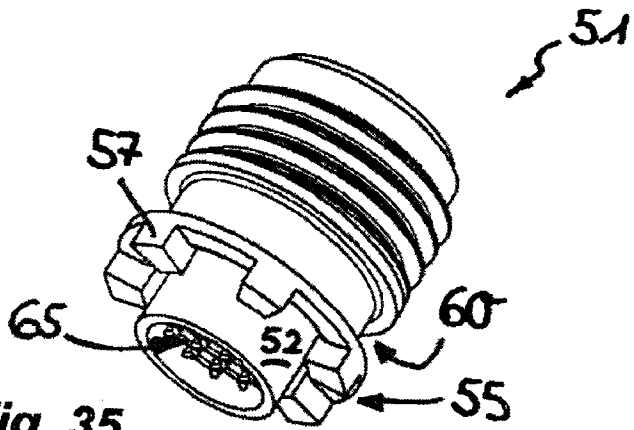
Figure 33:
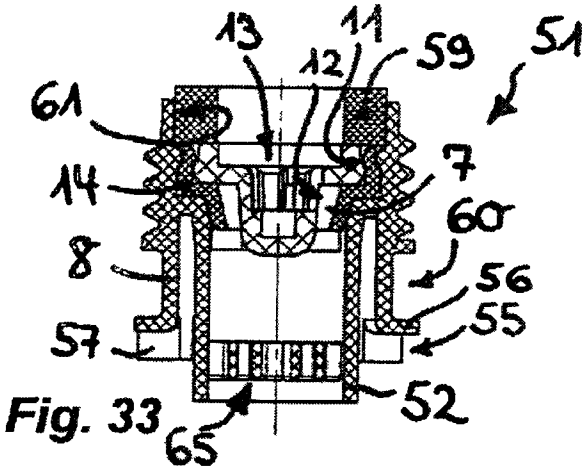
Figure 36:
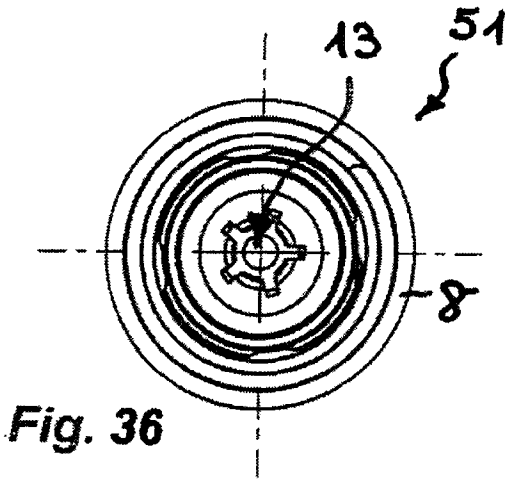

Each of the jet aerators 1, 2, 20, 21, 50 and 51 shown in FIGS. 1-15, 19-26 and 29-38 has a jet aerator housing or jet regulator housing 8 which can be inserted into a through opening, defining a water outflow 6, of the water outlet. While the jet aerator housing 8 of the jet aerators 1, 2, 20, 21 shown in FIGS. 1-15 and 19-26 can be inserted from the inflow side into the through opening defining a water outflow 6, the jet regulators 50, 51 shown in FIGS. 29-38 are inserted into the corresponding through opening from the outflow side of the water outlet and held there by an external thread provided on the housing outer circumferential side. In contrast, the components of the jet aerator 22 shown in FIGS. 27 and 28 are inserted directly into a correspondingly shaped outflow opening of the water outlet, without an additional jet aerator housing being necessary.

The jet aerator housing 8 of the jet aerators 1, 2, 20, 21 shown in FIGS. 1-15 and 19-26 is embodied in a rivet-shaped or mushroom-shaped manner for this purpose and can be inserted from the inflow side of the water outlet 3, 4, 5 therein up to an insert stop 9 projecting on the circumferential side on the jet aerator housing 8. This insert stop 9 can be embodied as a partially projecting stop lug. However, the jet aerators 1, 2, 20, 21 shown here have an insert stop 9 embodied as a surrounding annular flange on their jet aerator housing 8

In contrast, the jet aerator housings 8 of the jet aerators 50, 51 shown in FIGS. 29-38 are embodied essentially in a sleeve-shaped manner. As can be seen from FIGS. 29-38, the jet aerator housing 8 of the jet aerators 50, 51 has an outflow-side housing partial region 52, which has a housing outer circumference that is reduced compared to the inflow-side housing partial region 53. It is discernible in FIGS. 37 and 38 that the outflow-side housing partial region 52 can be inserted into an insert opening 53 of a turning tool 54 such that the turning tool 54 can be applied in a rotationally fixed manner on a tool working surface 55, which tool working surface 55 is provided on an annular shoulder 56 surrounding the housing partial region 52 on the outside. The tool working surface 55 is here thereby embodied in a crown-shaped manner and has projections 57 preferably uniformly spaced apart from one another in the circumferential direction and projecting over the annular shoulder 56 in the axial direction, wherein corresponding indentations or cavities are provided between these projections 57.

In the longitudinal sections according to FIGS. 29, 33, 37 and 38 it is discernible that the outflow-side housing partial region 52 of the jet regulator housing 8 is embodied in a sleeve-shaped manner. The water outflow of the jet aerators 50, 51 is thereby formed by a flow straightener which is embodied here as a perforated plate 65, which has flow-through holes arranged in a plane oriented transversely to the flow-through direction and bordered by flow guide walls. In the longitudinal sections according to FIGS. 29, 33, 37 and 38 it is discernible that the outflow side frontal edge of the housing partial region 52 embodied in a sleeve-shaped manner projects with a spacing over the flow straightener embodied as a perforated plate 65.

As can be clearly seen in FIGS. 2-4, 9-11, 19, 21, 24, 26, 29 and 33, at least one aerating opening 10 opening into the housing interior is provided on the circumferential side on the jet aerator housing 8.

In the region of the at least one aerating opening 10, the jet aerator 1, 2, 20, 21, 50, 51 has a housing cross-section that is enlarged compared to the housing partial region arranged on the outflow side and conically tapers preferably in the direction towards the outflow-side housing partial region. If the jet aerator housing 8 is now inserted up to the conically tapering housing partial region 23 into the assigned through openings of the water outlet, at least one aerating duct 24, which opens into the at least one aerating opening 10 and leads from the outflow side of the water outlet to at least one aerating opening 10, remains between the housing partial region arranged on the outflow side thereto and the adjacent inner circumferential wall or the edge region, delimiting the through opening, of the water outlet 3, 4, 5 and 40.

It is clear from the longitudinal sections in FIGS. 2, 4, 9, 11, 19, 21, 24, 26, 27, 29, 33, 37 and 38 that each jet aerator 1, 2, 20, 21, 22, 50, 51 has a central insert part 11, which has at least one through opening 12. A blind hole 13, here embodied in cross-shaped or also star-shaped in its internal cross-section, the circumferential-side hole wall of which has the at least one through opening 12, is provided on the central insert part 11. The first central insert part 11 can be inserted into a sleeve-shaped second insert part 14, wherein the first insert part 11 and the second insert part 14 delimit the cross-sectional narrowing 7 embodied here as an annular channel. It is clear in the longitudinal sections according to FIGS. 2, 4, 9, 11, 19, 21, 24, 26, 27, 29, 33, 37 and 38 that the cross-sectional narrowing 7 is embodied as a preferably conically tapering channel in the flow direction.

The first insert part 11 and the second insert part 14 have an insert stop embodied as an annular shoulder 15, 16, which interacts respectively with an insert counter-stop 17, 18 provided on the inner circumference of the second insert part 14 or of the jet aerator housing 8, which insert counter-stop is embodied as an annular shoulder surrounding in an annular manner.

It is also discernible in the longitudinal sections according to FIGS. 2, 4, 9, 11, 19, 21, 24, 26, 27, 29, 33, 37 and 38 that the first insert part 11 and the second insert part 14 extend on the outflow side into the region of the at least one aerating opening 10. In the jet aerators 1, 2, 20, 21, 50, 51 shown according to FIGS. 2, 4, 9, 11, 19, 21, 24, 26, 29, 33, 37 and 38, this aerating opening 10 is arranged in a partial region of the jet aerator housing 8. Locking means are provided between the first insert part 11 and the second insert part 14 as well as optionally between the second insert part 14 and the inner circumference of the jet aerator housing 8 or the water outflow replacing the jet aerator housing 8, which locking means hold the jet aerator 1, 2, 20, 21, 22, 50, 51 in the assembled state.

It is clear from a comparison of FIGS. 1-8, 19-28 and 29-38 with FIGS. 9-14 that respectively one flow straightener is provided in the sleeve-shaped jet aerator housings 8 or in the through opening of the water outlet replacing the jet aerator housing 8, which flow straightener is arranged in the flow direction after the cross-sectional narrowing 7. In the jet aerators 1, 20, 21, 22, 50 and 51 shown in FIGS. 1-8, 19-28 and 29-38, the flow straightener is embodied as a honeycomb-shaped lattice structure or perforated plate 19, while the outflow-side flow straightener 20 of the jet aerator 2 shown in FIGS. 9-15 is embodied as a guide cross 20.

The jet aerator 20 shown in FIGS. 19-22 has a second insert part 14, which has on its inflow-side frontal edge region a mounting flange 25 projecting radially outwards and embodied as an annular flange. Additionally or alternatively, comparable mounting flanges can be provided on the jet aerator housing 8 and/or on the first insert part 11. The jet aerator 20 shown in FIGS. 19-22 has the advantage that this jet aerator 20 can be easily attached, for example by laser welding or ultrasonic welding, to the circumferential edge region delimiting the through opening of the water outlet 40, so that no additional sealing means, which build up axially and/or radially and represent a substantial expenditure in terms of installation, is required.

FIGS. 23-26 show a jet aerator 21 in two different embodiments. The jet aerator 21 is embodied in a modular manner and has a retaining plate 26, 27, which can be inserted into an outlet nozzle 41 and is embodied as a plastic adapter, of which the retaining plate 27 shown in FIGS. 25 and 26 has a plurality of water outflows, while in contrast only one central water outflow 6 is provided in the exemplary embodiment shown in FIGS. 23 and 24.

Respectively one jet aerator 21 is provided in each of the water outflows 6. The jet aerator shown in FIGS. 23-26 provides comprehensive adaptation possibilities because the number of the water outflows 6 and the jet aerator 21 located therein can be adapted to the required flow-through capacity per time unit. The water outflows 6 of the jet aerator 21 shown in FIGS. 23-26 are arranged in the retaining plate 26 or 27, which is embodied in a compatible manner to the installation measurement of conventional jet regulator internal parts. Thus, by replacing the commercially available jet regulator internal part by the retaining plate provided with the miniaturized jet aerators 21, the user can obtain the advantage that the jet regulator thus produced has a comparatively low flow-through capacity, but which here, in contrast to previously known jet regulators, can be achieved in an aerated and thus very comfortable and non-splashing embodiment.

The jet regulator 21 shown in FIGS. 23-26 and embodied as a modular adapter solution makes it possible to reduce the water outlet to a very low volume flow of, for example, 11/m without having to do without the familiar non-splashing comfort jet enriched with air, wherein this comfort jet, however, has a considerably smaller diameter compared to commercially available jet regulators and differs substantially from a sharply bundled, spray individual jet that is not interfused with air, in particular due to its non-splashing jet quality.

FIGS. 27 and 28 illustrate that the jet aerator 22 can also be directly insertable without an additional jet aerator housing into the correspondingly embodied through opening of the water outlet 42. The through opening replacing the jet aerator housing is already injected into the sanitary water outlet as an injected and integrated outlet structure so that only the jet aerator 22 composed of a central first insert part 11 and a second insert part 14 has to be installed, which leads to a clear reduction in installation expenditure. A separate seal of the jet aerator 22 can also be omitted due to a corresponding press fit of the insert parts 11, 14 serving as diffuser and diffuser ring in the plate-shaped base of the sanitary water outlet.

Figure 37:
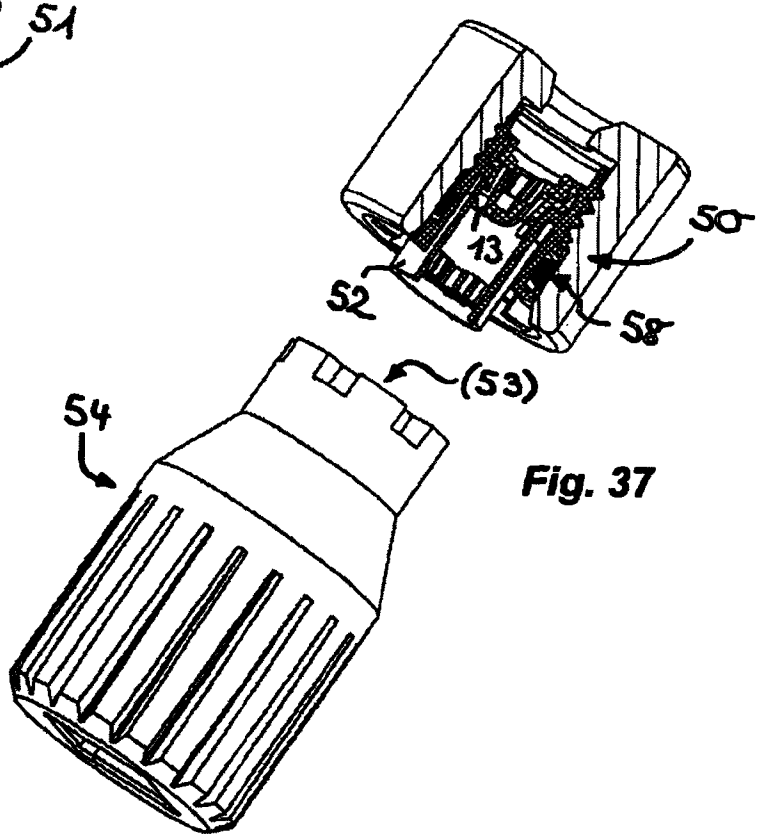
Figure 38:
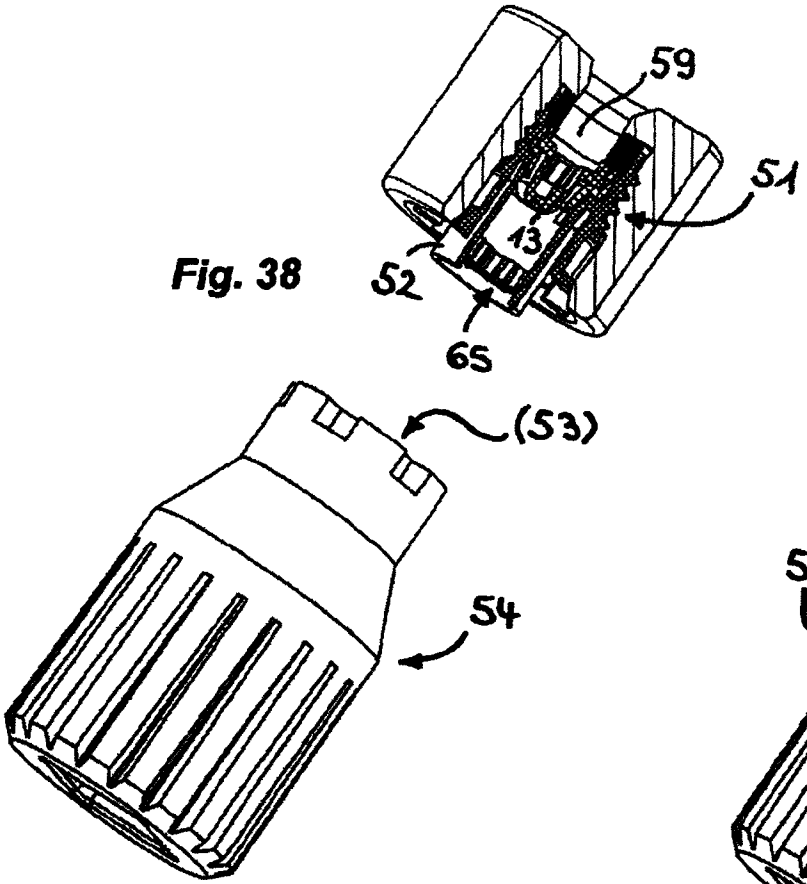

It is shown in FIGS. 37 and 38 that the outflow-side housing partial region 52 of the jet aerator 50, 51, is embodied as a centering aid active during the insertion into the insert opening 53 of the turning tool 54. The outflow-side frontal edge of the jet aerator housing 8 thereby projects with a spacing over the annular shoulder 56 having the tool working surface 55.

A comparison of FIGS. 29-32 and 37 with FIGS. 33-36 and 38 makes it clear that the jet aerators 50, 51 are essentially identical in construction. The jet aerators 50, 51 have respectively one sealing ring 58 and 59 respectively, which is provided for the axial and/or radial sealing of the jet aerator with respect to a line section adjacent on the inflow side and in particular with respect to a sanitary outlet fitting. While the sealing ring 58 of the jet aerator 50 shown in FIGS. 29-32 and FIG. 37 is arranged in an annular groove 60 arranged on the outer circumferential side of the jet aerator housing 8 and is provided for radial sealing, the sealing ring 59 of the jet aerator 51 shown in FIGS. 33-36 and 38 is provided in a housing receptacle 61 arranged on the inflow-side housing frontal side and provided for axial sealing. The sealing ring 59 is held in the jet regulator housing 8 of the jet aerator 51 with a press fit, wherein a press fit of this type not only holds the sealing ring 59 securely in the housing receptacle 61, but also serves as a securing means against loss for the insert parts 11, 14.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A sanitary water outlet with a plurality of water outflows spaced apart from one another forming a corresponding plurality of visibly separately emerging water jets, wherein respectively one jet aerator is provided in at least a plurality of the water outflows, each of the jet aerators has a cross-sectional narrowing that accelerates a partial quantity of water flowing to a water outlet flowing through the jet aerator such that an underpressure is produced on the outflow side of the cross-sectional narrowing, and each jet aerator has a mixing region following its cross-sectional narrowing that mixes the partial quantity flowing through with ambient air suctioned in due to the underpressure such that an aerator water jet emerges from each jet aerator, wherein the jet regulator has a central insert part that has at least one through opening, and wherein the central insert part is insertable into a sleeve-shaped second insert part and the central insert part and the second insert part delimit the cross-sectional narrowing as an annular channel.

2. The sanitary water outlet according to claim 1, wherein each jet aerator has a jet aerator housing and the jet aerator housings are respectively insertable into a through opening of the water outlet.

3. The sanitary water outlet according to claim 1, wherein at least one jet regulator with a mushroom-shaped or rivet-shaped jet regulator housing is insertable from an inflow side of the water outlet up to an insert stop projecting on the circumferential side on the jet regulator housing.

4. The sanitary water outlet according to claim 3, wherein the insert stop is a surrounding annular flange.

5. The sanitary water outlet according to claim 1, wherein on a circumferential side on the jet aerator housing at least one aerating opening is provided that opens into a housing interior.

6. The sanitary water outlet according to claim 1, wherein at least one aerating duct, leading from the outflow side of the water outlet to at least one aerating opening, is arranged between at least one jet aerator housing and an edge region of the water outlet delimiting a through opening.

7. The sanitary water outlet according to claim 1, wherein the jet aerator housing has, in a region of the at least one aerating opening, a housing cross-section enlarged in comparison with a housing partial region arranged on the outflow side and tapering conically in a direction of the outflow-side housing partial region.

8. The sanitary water outlet according to claim 1, wherein a blind hole is provided on the center insert part, the blind hole has a circumferential-side hole wall through the at least one through opening.

9. The sanitary water outlet according to claim 1, wherein the cross-sectional narrowing is a channel tapering conically in a flow direction.

10. The sanitary water outlet according to claim 1, wherein the central insert part is insertable into the second insert part and the second insert part is insertable into the jet regulator housing, and an insert stop respectively delimits an insert path.

11. The sanitary water outlet according to claim 1, wherein the central insert part or the second insert part has an insert stop this is an annular shoulder, which interacts with an insert counter-stop on the inner circumference of the second insert part or the jet regulator housing as an annular stop surrounding preferably in an annular manner.

12. The sanitary water outlet according to claim 1, wherein the central insert part and the second insert part on the outflow side extends up to a housing section of the jet aerator housing reaching into a region of at least one aerating opening.

13. The sanitary water outlet according to claim 1, wherein at least one water passage element embodied as a jet regulating device, a homogenization device or a flow straightener, and having a network structure, lattice structure or a guide cross, is provided after the cross-sectional narrowing in the flow direction.

14. The sanitary water outlet according to claim 1, wherein a mounting flange projects on a circumferential side on the central insert part, the second insert part or the jet regulator housing, the mounting flange tightly connectable in a surrounding manner to the edge region of the water outlet bordering the water outflows.

15. The sanitary water outlet according to claim 14, wherein mounting flange is welded, adhered or otherwise connected to the edge region surrounding the water outflow.

16. The sanitary water outlet according to claim 1, wherein the water outlet has a retaining plate that insertable into an outlet nozzle, the retaining plate has a plurality of water outflows respectively provided by one jet regulator.

* * * * *